US009854344B2

(12) United States Patent
Cheney et al.

(10) Patent No.: US 9,854,344 B2
(45) Date of Patent: Dec. 26, 2017

(54) WIRELESS EARPHONES AND EARPHONES CHARGING CASE

(71) Applicant: Braven LC, Orem, UT (US)

(72) Inventors: John Craig Cheney, Orem, UT (US); Robert Murdock, Lindon, UT (US); Christian Bao Macias, Orem, UT (US)

(73) Assignee: BRAVEN, LC, Orem, UT (US)

( * ) Notice: Subject to any disclaimer, the term of this patent is extended or adjusted under 35 U.S.C. 154(b) by 0 days.

(21) Appl. No.: 15/396,685

(22) Filed: Jan. 1, 2017

(65) Prior Publication Data

US 2017/0195770 A1 Jul. 6, 2017

Related U.S. Application Data

(60) Provisional application No. 62/274,355, filed on Jan. 3, 2016.

(51) Int. Cl.
*H04R 1/10* (2006.01)

(52) U.S. Cl.
CPC ..... *H04R 1/1025* (2013.01); *H04R 1/105* (2013.01); *H04R 1/1016* (2013.01); *H04R 1/1033* (2013.01); *H04R 1/1041* (2013.01); *H04R 1/1058* (2013.01); *H04R 2420/07* (2013.01); *H04R 2420/09* (2013.01)

(58) Field of Classification Search
CPC ..... H04R 1/1041; H04R 2420/07; H04R 1/1016; H04R 1/1033; H04R 2420/09; H04R 1/1025; H04R 1/1058; H04R 1/105
USPC ..... 381/74
See application file for complete search history.

(56) References Cited

U.S. PATENT DOCUMENTS

2014/0376763 A1* 12/2014 Stevinson ..... A45C 11/00 381/370

* cited by examiner

*Primary Examiner* — Paul S Kim
(74) *Attorney, Agent, or Firm* — Manatt, Phelps & Phillips, LLC

(57) ABSTRACT

Rechargeable wireless earphone systems and charging cases are disclosed. The rechargeable charging case, which doubles as a storage case for the earphone components, includes externally accessible charging ports adapted to charge the rechargeable battery contained therein as well as for charging other electronic devices. The earphones are configured such that they may be used even when charging or when the earphone system battery is depleted. An alignment and positioning mechanism is provided to align and electrically connect charging contacts of a controller housing of the earphone system with charging contacts provided in the charging case to better secure and facilitate the charging process when the controller is received within the charging case. Reversibly detachable ear hooks and ear canal plugs are uniquely designed and configured to be independently attached to the earphone housing and compliantly adjustable to the desired shape for user comfort. The ear hooks and plugs may be configured such that the ear hooks at least partially encircle the ear plugs when both are attached to the earphone housing and either the ear hooks and/or ear plugs may be detachable from the earphone without removal of the other. Illuminated ear hooks and cable are also disclosed.

20 Claims, 12 Drawing Sheets

WIRELESS EARPHONES AND EARPHONES CHARGING CASE

INCORPORATION BY REFERENCE TO RELATED APPLICATIONS

This application claims the benefit of priority under 35 U.S.C. §119(e) to U.S. Provisional Application No. 62/274,355, filed Jan. 3, 2016. The above application is hereby incorporated herein by reference in its entirety and is to be considered as a part of this specification.

BACKGROUND OF THE INVENTION

Field of the Invention

This patent document relates to wireless earphones and earphone charging cases.

Description of the Related Art

Earphones, or earbuds, typically are comprised of a pair of small speakers, each of which are configured to be attached to the users outer ear and inserted or plugged into a user's ear canal. Earphones, like other headphones, are designed to allow a user to listen to an audio source privately by emitting sound in immediate proximity to the user's ear.

Earphones are either wired directly to the audio source such as an audio amplifier, radio, CD player, portable media player, mobile phone, video game consoles, electronic musical instrument, or use wireless technology such as Bluetooth to connect to such devices. Wireless earphones are capable of providing users with more flexibility or freedom than earphones directly wired to the audio source. However, wireless earphones typically require a battery to store and provide power to the earphones. When the battery is low or out of power, charging the battery is required to allow continued usage which typically requires a charging cable to be connected to the earphones and thereby inhibits use of the earphones. In addition, if the user wishes to play an audio source from a device through a Bluetooth connection with the earphones, such connection may be impossible to perform when the battery of the earphones is depleted and thereby renders the earphones nonfunctional. The frustration can further multiply when there is no convenient charging outlet available for example when traveling. Moreover, users can sometimes be irritated by the contact with earphone which may decrease the enjoyment of such devices. The inventors here therefore have recognized a continuing need to develop new earphone systems that are capable of providing a more user friendly experience.

SUMMARY OF THE INVENTION

There exists a continuing need for wireless earphones and charging case to resolve the problems above. Earphone and earphone systems are disclosed. Various aspects are set forth in this disclosure as set forth in the written description and drawings including the claims.

BRIEF DESCRIPTION OF THE DRAWINGS

These and other features, aspects and advantages are described below with reference to the drawings, which are intended to illustrate but not to limit the invention. In the drawings, like reference characters denote corresponding features consistently throughout.

DETAILED DESCRIPTION OF THE PREFERRED EMBODIMENT

Figure 1:
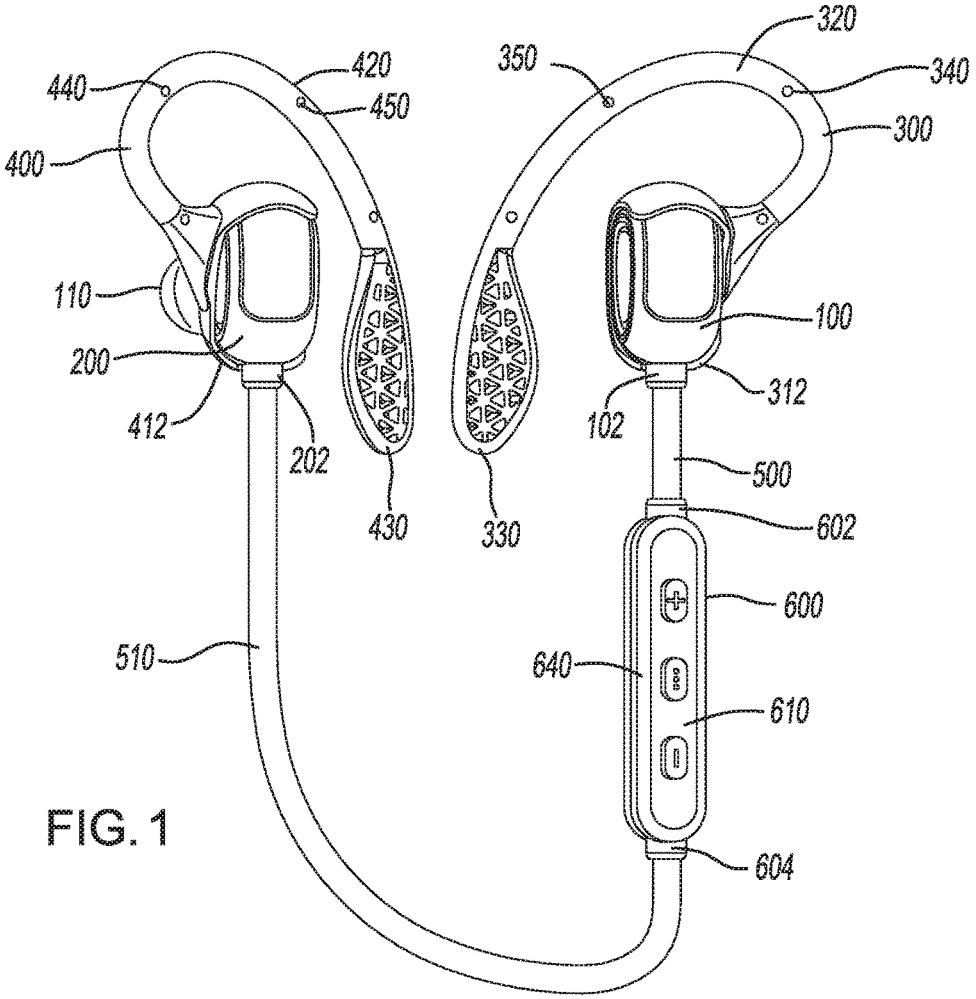
FIG. 1 is a perspective view of an exemplary embodiment of a wireless earphone assembly comprising a pair of right and left earphones each with corresponding detachable ear hooks and detachable bullet or ear canal plugs mounted thereon and a controller connected on either side by cables to the earphones.

Rechargeable wireless earphone systems and charging cases capable of enhancing user experience are disclosed. The system includes earphones, 100, 200, ear hooks 300, 400, a controller 600, 650, that is cabled 500, 510 on either side to the earphones 100, 200, and rechargeable charging cases 700, 750 that are capable of facilitating the storage and charging of the earphones as well as other electronic devices. Various aspects of these components are further described herein with reference to the drawings.

FIG. 1 is a perspective view of an exemplary embodiment of a wireless earphone assembly comprising a pair of wireless earphones 100, 200 with corresponding detachable ear hooks 300, 400 and detachable bullet or ear canal plugs, 110, 210 being mounted on the earphone housings 120, 220 and a controller 600 connected to the earphones via cables 500, 550. Earphone 100 is adapted to a user's right ear while earphone 200 is adapted to a user's left ear. Wireless earphones 100, 200 provide users with more flexibility than earphones with direct wire connection to the signal source. corresponding detachable ear hooks.

Figure 9:
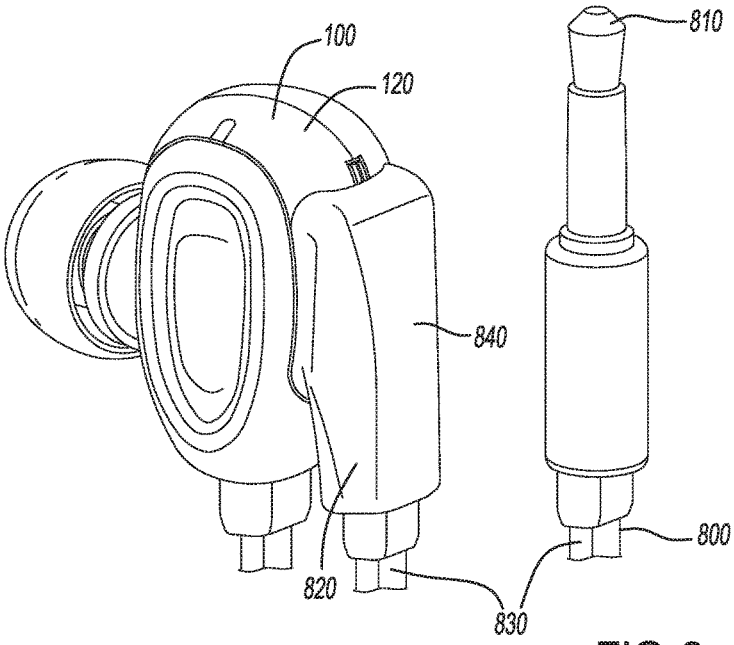
FIG. 9 is a perspective view of the earphone of FIG. 2A with an audio line-in connection that can be connected to an audio source. The other end is configured to be connected to the earphone directly as depicted in FIG. 9 or connected to the controller.

Illustrated in FIGS. 2A-2G are the perspective, front, rear, left, right, top and bottom views of an exemplary embodiment of the right earphone 100. A replaceable ear canal plug or bullet 110 is illustrated as being connected within the earphone speaker housing 120. The earphone speaker housing further includes a removable cap door 121 to allow access to the internal compartment and components of the speaker housing 120. The speaker housing 120 includes a speaker and may also include a rechargeable battery, and a micro USB connector that is adapted to being connected to an audio source via and independent cable as illustrated in FIG. 9. Notably, the earphone 100 is illustrated detached from its ear hook 300 to provide improved visibility to the earphone structure and design. While the earphone illustrated is adapted to the right ear, it should be understood that the mirror image of the earphone is employed for the left ear, as illustrated in FIG. 1.

Figure 2A:
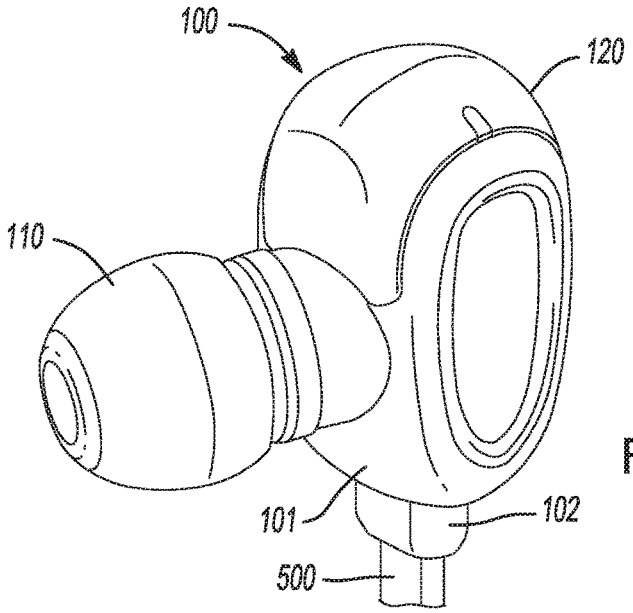
FIGS. 2A-2G are the perspective, front, rear, left, right, top and bottom views of an exemplary embodiment of an earphone adapted to be connected to a user's right rear.
Figure 2B:
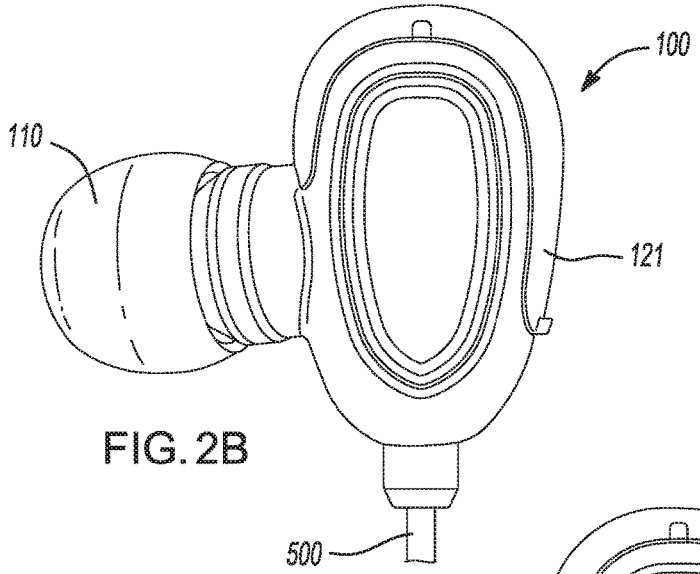
Figure 2C:
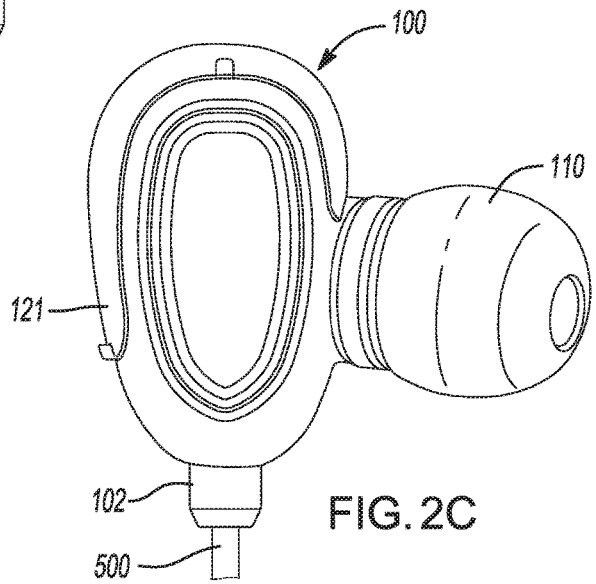
Figure 2D:
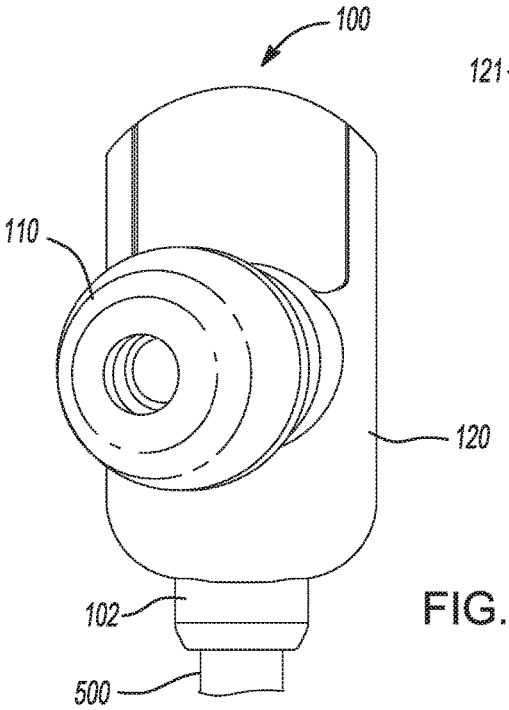
Figure 2E:
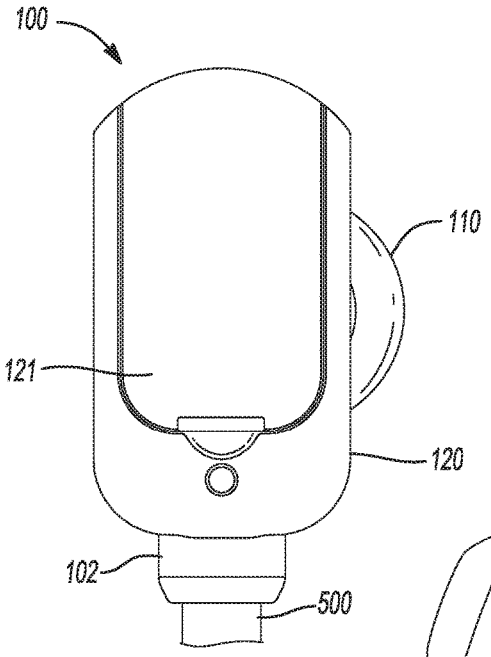
Figure 2F:
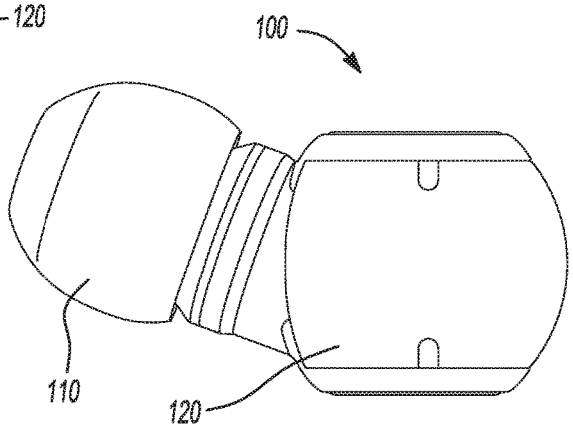
Figure 2G:
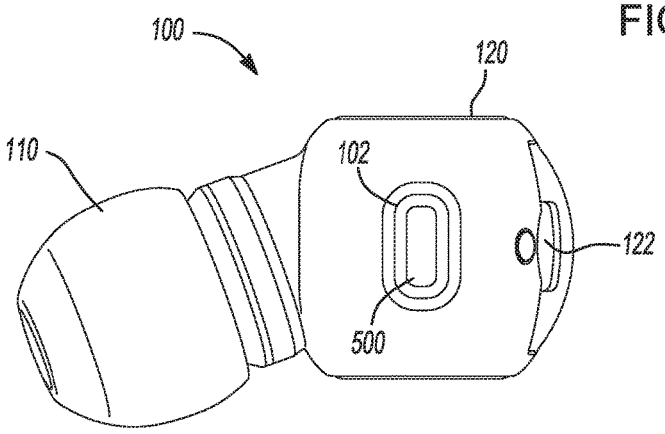
Figure 3A:
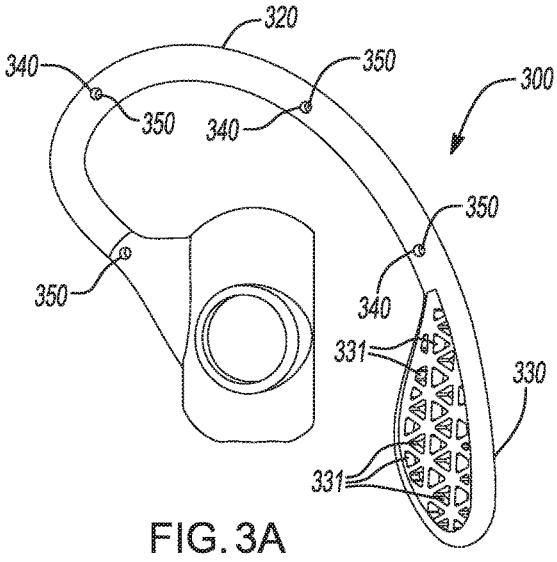
FIGS. 3A-3B are perspective views of an exemplary embodiment of the detachable ear hook depicted in FIG. 1. The ear hook is adapted to being reversibly or detachably mounted around the earphone housing as depicted in FIGS. 2A-2G. The ear hook has generally a curved configuration with one end being adapted to attach to the speaker housing and the other regions being adapted to wrap around the user's ear. The ear hook 300 illustrated is adapted to the right earphone illustrated in FIGS. 2A-2G. However, it should be understood that the mirror image of that ear hook would be employed for the left earphone, as illustrated in FIG. 1.
Figure 3B:
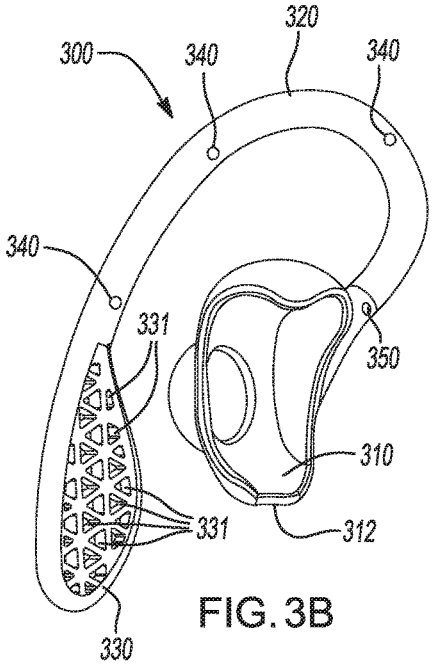

FIGS. 3A-3B are perspective views of an exemplary embodiment of the detachable ear hook 300 a depicted in FIG. 1. The ear hook 300 is adapted to being reversibly or detachably mounted around the earphone housing 120 as depicted in FIGS. 2A-2G. The ear hook 300 has generally a curved configuration with one end including a cavity 310 adapted to being mechanically attached over and to the speaker housing 120 while the other regions 320, 330 are configured to wrap around the user's ear. The end region 330 further including a pattern of small repeating triangularly shaped apertures 331 extending therein. The apertures reduce the weight of the ear hook and are capable of providing improved flexibility and hence comfort to the user. The ear hook 300 illustrated is adapted to the right earphone illustrated in FIGS. 2A-2G. However, it should be understood that the mirror image of that ear hook 300 would be employed for the left earphone, as illustrated in FIG. 1.

Figure 4:
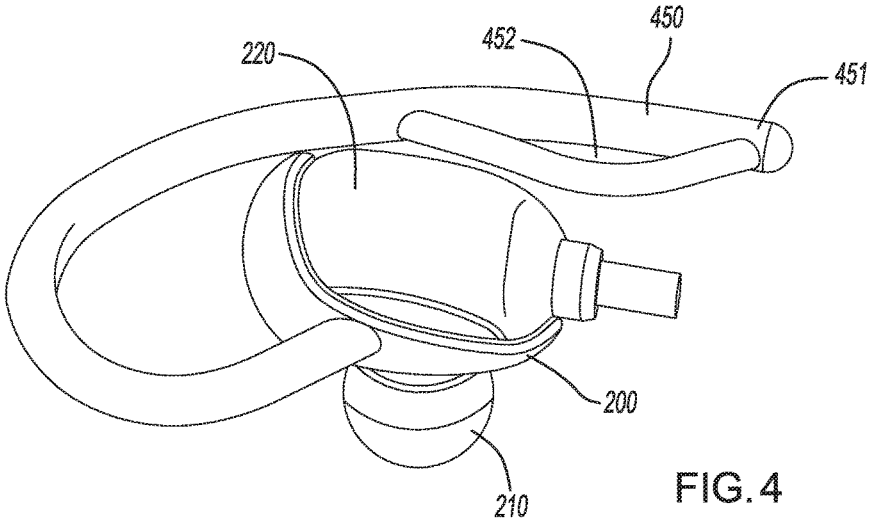
FIG. 4 is a perspective view of another exemplary embodiment of an earphone adapted to a user's left ear mounted with another exemplary embodiment of an ear hook.

FIG. 4 is a perspective view of another exemplary embodiment of an earphone 200 adapted to a user's left ear mounted with another exemplary embodiment of an ear hook design 400 detachably mounted to the speaker housing as previously. This particular implementation includes a large aperture 452 extending through the end section 451 of the ear hook 400 and the connection cavity that couples to the speaker is designed to only partially encircle the ear canal plug as opposed to the ear hook design depicted in FIGS. 1 and 3A-B, which includes a coupling cavity that is configured to entirely encircle the ear canal plug when attached to the earphone speaker housing.

As illustrated in FIGS. 1-4B, the replaceable ear canal plug or bullet 110 is detachably coupled to the speaker housing 120 in an aperture proximate to the speaker internal thereto. The bullet/plug 110 is configured to be plugged partially or completely into a user's ear canal to secure the earphone into operating position relative to the user's ear and provide noise isolation to the inner ear of the user. The ear plug and ear hook may be used alone or in combination to secure the earphone into operating position. Use of the ear plug alone or the ear hook alone with the speaker allows greater flexibility to the user in finding a comforting fit and use. The ear hook or ear plug are also modularly configured such that either may be detached from the speaker independently of one another while the other is still coupled to the speaker housing.

The bullet/plug 110 can be made from silicone rubber, elastomer, foam, or other suitable compliant materials that allow for deformation to the ear of the user. The bullet/plug may be made of transparent or opaque materials. The speaker housing 120 may be formed of a more rigid material such as plastic or metal and may be covered or overlaid with softer material, such as rubber.

Although not depicted alone, the left earphone 200 is the mirror images of the right earphone 100 and also may include the components described in connection with the right earphone such as an ear canal plug 210 and a speaker housing 220.

A rechargeable battery (not shown) can be installed in one or both of the speaker housings 120, 220 and electrically connected through the cables 500, 510 to the controller 600 and thereby recharged as described in more detail below. Thus, it should be understood that the rechargeable battery may only be installed in the right speaker housing 120, may only be installed in the left speaker housing 220, or may be incorporated into both the right speaker housing 120 and the left speaker housing 220. In yet another implementation, a rechargeable battery is installed in the controller 600 housing with or without separate rechargeable batteries housed in one or both of the speaker housings 120, 220.

The rechargeable batteries are provided to power the speakers and the controller 600 circuitry. When one or more rechargeable batteries are provided only in the speaker housing, such batteries may power both the speakers and the controller 600 circuitry. When one or more rechargeable batteries are provided only in the controller 600 housing, that battery or batteries may power both the speakers and the controller 600 circuitry. When one or more rechargeable batteries are provided in both the controller 600 housing and one or more of the speaker housings 120, 220, the batteries may power different components. For example, the speaker batteries may power the speakers only and the controller 600 battery may power the circuitry in the controller only or vice-versa.

Figure 17:
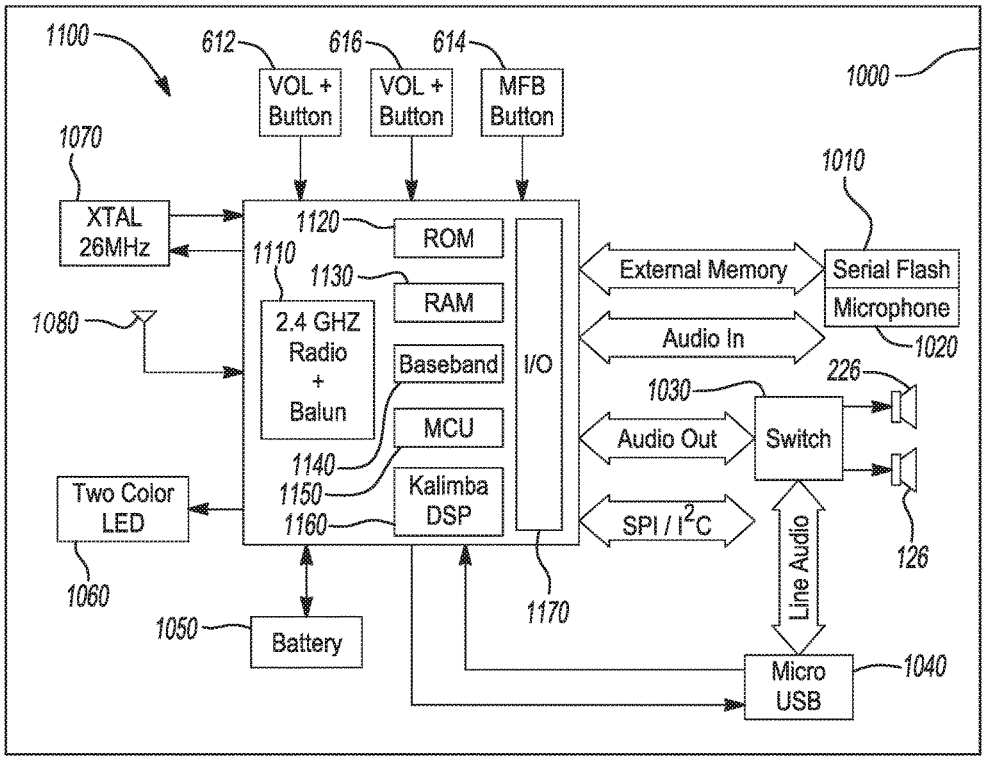
FIG. 17 illustrates an exemplary circuit block diagram of an earphone system.

When multiple rechargeable batteries are employed, those batteries may provide back-up or secondary power to one another such that when one primary battery is depleted, the other battery (which would serve as a secondary back-up battery to the extent not depleted) may provide power to the circuitry or component for which the depleted battery was providing power to. In this way, the earphone system can maintain wireless operation even when one (or less than all) of the system batteries is depleted. Implementation of an exemplary circuit block diagram is shown in FIG. 17. A switch 1030 communicates with the PCB 1100, which controls and drives the audio. The switch may be passive or powered and can be configured to route audio (and power) between the PCB and the right speaker 126 housed in the right earphone 100, the left speaker 226 housed in the left earphone 200, or both. In another embodiment, the switch 1030 is a manual switch that can be controlled by a user. Thus the switch 1030 can be a powered switch, a non-powered passive switch, or a physical switch that is manually controlled by the user.

A right cable section 500 can be configured to electrically couple to the controller housing 600 to transfer audio signals to the speaker housing 120 of the right earphone 100. A sleeve 102 (see also FIGS. 5A-5B) can be provided at the bottom end of the right earphone 100 to receive the right cable section 500 to relief potential strain applied to the right cable section 500 when used. The sleeve 102 can be made of elastic material. In one embodiment, the sleeve 102 is made of thermoplastic polyurethane (TPU).

A left cable section 510 can be configured to electrically couple to the controller housing 600 to transfer audio signals to the speaker housing 220 of the left earphone 200. A sleeve 202 (see also FIGS. 5A-5B) can be provided at the bottom end of the left earphone 200 to receive the left cable section 510 to relief potential strain applied to the left cable section 510 when used. The sleeve 202 can be made of elastic material. In one embodiment, the sleeve 202 is made of thermoplastic polyurethane (TPU).

It is understood that other shapes or configurations can be adapted for the right cable section 500 and/or the left cable section 510 without deviating from the present invention. It should also be understood that the cable 500, 510 also provides power (e.g., from one or more rechargeable batteries) to the speakers 100, 200 from the controller 600 circuitry (when power source to the earphone system is provided from the controller 600) and/or from the speakers to the controller 600 circuitry (when power source to the earphone system is provided from one or both of the speakers) as previously described in connection with rechargeable battery arrangements described above (see also FIG. 17).

Each ear hook 300, 400 are configured to be removably attached and detached by the user to their corresponding respective speakers housings 120, 220. In the illustrated embodiments the reversible attachment/detachment is implemented by including a retention cavity 310, 410 at the proximate end regions of each ear hook 300, 400 that is configured to receive and attach to their respective speaker housing 120, 220. The cavities 310, 410 are configured to have internal surfaces that wrap around and conform to the external surfaces of their respective speaker housing, 120, 220 and may include an aperture that completely or partially encircles the ear canal bullet/plug connection opening in the speaker housing.

In a preferred implementation the speaker housing is configured to snap into the retention cavity of the ear hook around the ear canal bullet/plug connection opening in the speaker housing with the cable 500 or 510 directed through an opening or notch/indentation at the bottom edge region 312, 412 of the cavity 310, 410 that has a conforming shape to the external perimeter of the cable/sleeve extending there-through. Thus, in the illustrated embodiment, the ear hook may be attached and detached from the speaker housing without removal of the ear canal bullet/plug (from the speaker housing and may be used with or without the ear canal bullet/plug. Alternatively, the ear canal bullet/plug may be used with or without the ear hooks and may be attached to the speaker housing with or without removal of the ear hook from the housing.

Each ear hook includes regions extending distally away from the attachment cavities, 310, 410 that include an over-the-ear region or portion 320, 420 that is configured to wrap around the top of the user's outer ear and an end section or region 330, 430 that is configured to extend underneath the bottom of the user's ear. Portions 320, 420 may be tube-shaped and be molded (or co-molded) with or connected to their respective attachment cavities 310, 410 at one end and molded (or co-molded) with or connected to their respective end sections/regions 330, 430 at the other end. As illustrated, in order to enhance the user experience and provide an easier gripping surfaces to mount and position the ear hooks over the user's ears, the end sections 330, 430 may be formed to include a relatively wider and/or flatter configuration than the portions 320, 420 that are configured to wrap around the upper ear.

Ear hook portions 320, 420, 330, 430 may be made from any suitable material. In one implementation, an elastic or flexible material (such as gloss, or semi-transparent rubber) is employed to provide comfort and a better fit with the external shape of the user's ear. A more rigid polymer may be used to form the cavity regions 310, 410 and/or the end regions 330, 430. Co-molding may be used to integrate the ear hook or portions thereof when different materials are used in different regions of the ear hook.

Figure 18:
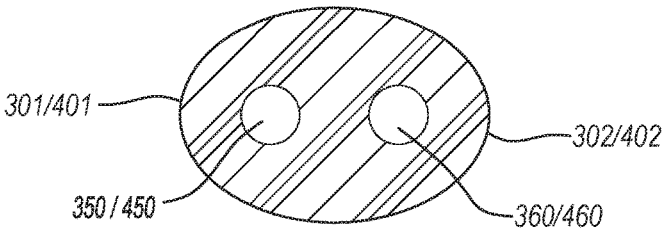
FIG. 18 is an illustration of a cross-section of an ear hook illustrating the wire core element being positioned within the ear hook away from the proximate edge configured to be adjacent to the user's ear.

A pliable wire core 350, 450 may be include in the ear hook 200, 400 in either or both regions 320, 420 and/or 330, 430 to allow the user to modify the external configuration of the ear hook to better conform with the user's ear. As illustrated, the wire core 350, 450 is internally positioned within the ear hook. As illustrated in FIG. 18, the position of the wire core elements 350, 450 may be offset from the center axis of the ear hook housing to facilitate added comfort and usability. For example, the ear hook may have a proximate edge that is configured to be in contact with the user's outer ear and a distal (or leading) edge removed therefrom. The wire core elements 350, 450 may be positioned nearer the distal edge as compared to the proximate edge of the ear hook housing. In this way, the proximate edge has a greater thickness of the softer material that forms the ear hook, the additional thickness of which can provide additional cushioning to the user's ear, while the more distally positioned wire core elements 350, 450 can still function to allow the user to conform the compliant ear hook to the desired shape.

Holes 340, 440 extending internally from the outer surface of the ear hook may provide the user with a visual window to the wire core 350, 450. When a semi-transparent material is employed to form the external walls of the ear hook, visibility to the wire core 350, 450 may be provided without the use of holes, 340, 440 and hence it may be desirable for such holes to be excluded partially or completely. In addition, the holes 340, 440 may be formed during the molding process to ensure proper position of the wire core elements 350, 450 in the ear hook housing. For example, the mold may include positioning fixtures that extend into the ear hook housing and position the wire core 350, 450 at the front or distal edge of the ear hook away from the user's ear. When the mold is removed the positioning fixtures can leave the holes 340, 440 in the ear hook.

While in the illustrated embodiment, the wire core 350, 450 is provided internally generally centrally within the ear hook, it should be understood that the wire core 350, 450 could be provided as an external component or positioned along one side of the perimeter of the ear hook in one or both regions 320, 420, and/or 330, 430. The wire core 350, 450 may be configured as a more rigid component that the overlying external housing of the ear hook and/or made of a relatively more rigid material, but yet is still capable being readily manipulated by the user to allow for bending or shaping the ear hook into the desired shape or configuration. In one embodiment, the wire core 350, 450 has a round cross-section at the center portion and flat cross-section near the two ends. The wire core 350, 450 be made of one or more slender string-like pieces of metal or any other suitable material.

It is understood that other ornamental shapes or configurations can be adapted for the ear hook 300 without deviating from the present invention.

Figure 5A:
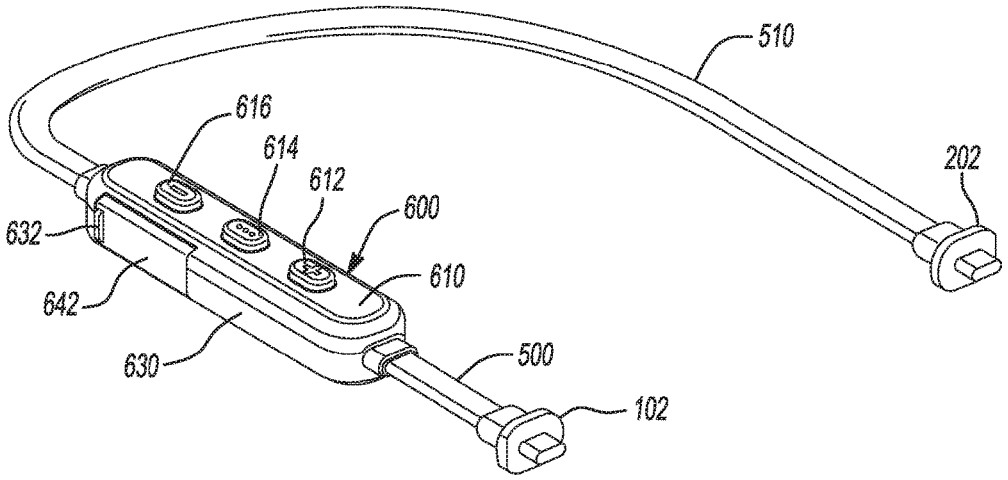
FIGS. 5A and 5B are perspective views of an exemplary embodiment of the cabled controller depicted in FIG. 1.
Figure 5B:
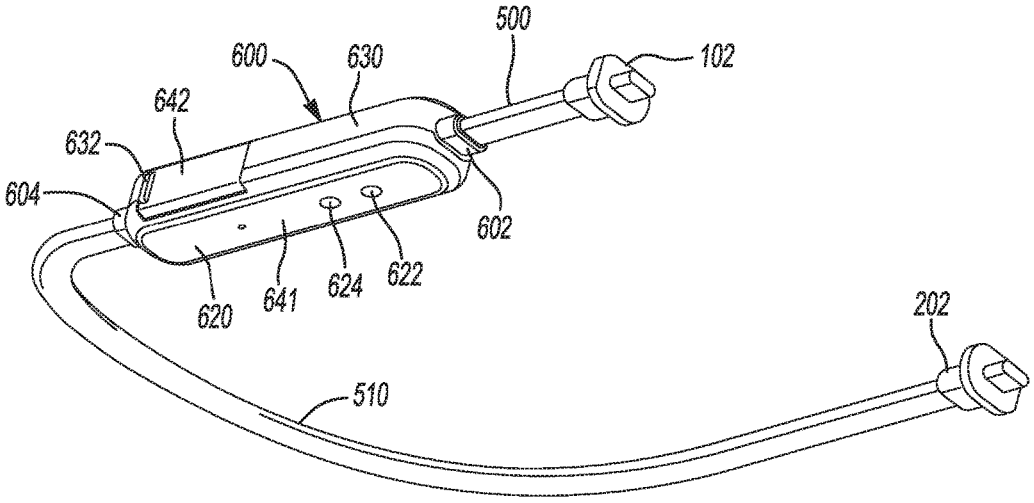

FIGS. 5A-5B are perspective views of an embodiment of the controller 600 and cable 500, 510 depicted in FIG. 1. The controller 600 housing may be formed of any suitable materials such as a rigid plastic with or without and exterior material overlay such as TPE covering the external surfaces. The controller 600 housing, in the illustrated embodiment includes opposing a front and rear sides 610, 620 and opposing side walls 630, 640 extending there-between, which together define an internal controller housing compartment that contains the controller electrical components and circuitry.

Sleeves 602, 604 can be provided at the top end and the bottom end of the controller housing 600 to receive the right cable section 500 and the left cable section 510, respectively, to relief potential strain applied to the right cable section 500 and the left cable section 510. The sleeves 602, 604 can be made of, for example, thermoplastic polyurethane.

One or more control buttons and charging interfaces are provided on the controller 600 to facilitate operation. In the illustrated implementation, the front side 610 includes power 614 and "+" and "−" volume control 612, 616 buttons, while the opposing rear side 620 includes a pair of charging contacts 622, 624. The side walls may include a USB port 632 for line connection that may be positioned on the external surface of the controller or beneath a detachable door 642, which provides access to the electronic components residing within the controller 600 housing including a rechargeable battery that may be included therein.

In one implementation, the controller effectively acts as a remote control with the "+" and "−" volume control buttons 612, 616 not only being configured to adjust the speaker volume but also control the audio source to allow the user to cue the audio by skip forward and backward when listening to music. The power on/off button 614 not only is configured to turn on/off the system but may also be configured to control other audio source functionality, for example, controlling whether or not the user wants to answer an incoming call and/or hang up an existing phone call that is routed to the earphone system.

The micro USB port 632 may be configured to be attached to a charging cable connected to an external power source or an Aux-in cable (e.g., FIGS. 9-12, 16) attached to an external audio source. In either condition, the external power source and audio source would be capable of supplying power to the controller 600 and/or other components in the earphone system to allow for operation of the system even system battery power is depleted. When the Aux-in cable 800 (see also FIGS. 9-12, 16) is connected to the micro USB port 632, the Bluetooth connection circuitry is bypassed and the earphones work like wired conventional earphones. When the charging cable 850 (see FIG. 16) is connected to the micro USB port 632, the Bluetooth connection circuitry is not bypassed and the earphones may continue to operate in wireless mode while the system is being charged.

Electrical components to facilitate this functionality may be provided in whole or in part on a printed circuit board (PCB) 1100 positioned within the controller housing 600, 650. FIG. 17 illustrates an exemplary circuit block diagram of an earphone system 1000. The controller (e.g., 600, 650) may be configured to house a printed circuit board (PCB) 1100 which may be mounted with the requisite circuit components to allow for functionality of the earphone system in accordance herewith. For example, the PCB 1100 may include a crystal oscillator 1070, a transformer 1110, a read-only memory (ROM) 1120, a random access memory (RAM) 1130, a baseband processor 1140, a microcontroller (MCU) 1150, a digital signal processor (DSP) 1160, and inputs/outputs (I/O) 1170 that connect to serial flash 1010, a microphone 1020, a switch 1030, and a micro USB 1040 (which can be the micro USB port on the speaker 122 or the controller 632). Input buttons for volume control 612, 616 and a multi-functional button 614 for pairing and other control functions are also connected to the PCB 1100. An appropriate antenna 1080 to facilitate wireless communication (a 2.402-2480 MHz antenna) with the audio source is connected to the PCB 1100. LED indicator lights 1060 may also be connected to the PCB 1100. One or more batteries 1050 powers the PCB. The battery 1050 may be located in the controller housing and/or in one or both of the earphone housings. When located in the earphone housing cables 500 and/or 510 route power from the battery in the earphone housing to the controller. The controller circuitry facilitates the wireless communication with an external audio source, controls and drives the audio to the speakers, controls the routing of power and charging from and to the system rechargeable batteries.

Figure 6A:
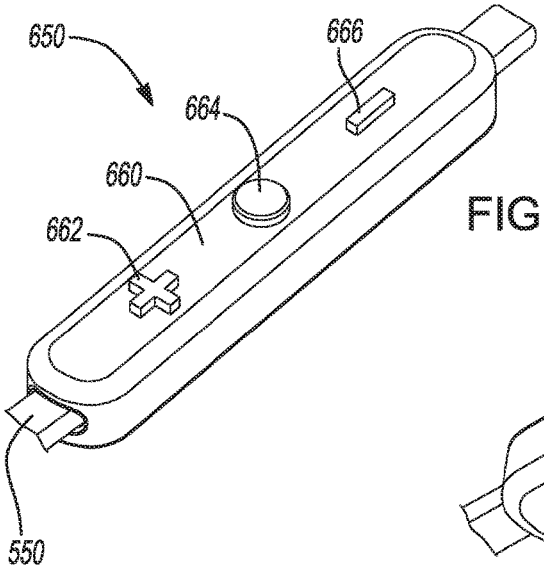
FIGS. 6A and 6B are perspective views of another exemplary embodiment of the controller depicted in FIG. 1.
Figure 6B:
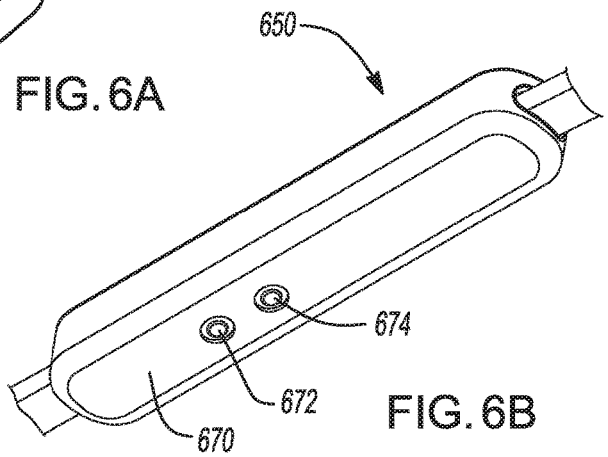

FIGS. 6A and 6B are perspective views of another embodiment of a controller housing 650 depicted in FIG. 1. This controller housing 650 is similar configuration as that of controller housing 600 except that there is no USB port provided.

A battery charging circuit is provided in the earphone system to facilitate battery charging and providing power to the system. In a one implementation the battery charging circuit is included within the controller 600, 650 housing rather than in the speaker housings, 120, 220 to lessen the weight of the earphones 100, 200 and hence provide potentially greater comfort to the user. When earphone system battery power is low or completely depleted, the controller 600, 650 can be connected to a charger or external charging source. To facilitate continued use of the earphone system, even when the earphone battery power is depleted, audio signals can be transmit directly to the earphones 100 via a direct connection cable, such as that illustrated in FIGS. 9-12, between the audio source and the controller or directly to one or both earphones. In this way users are not deprived of use of the earphones when battery power is depleted or when the system is being charged.

Figure 7:
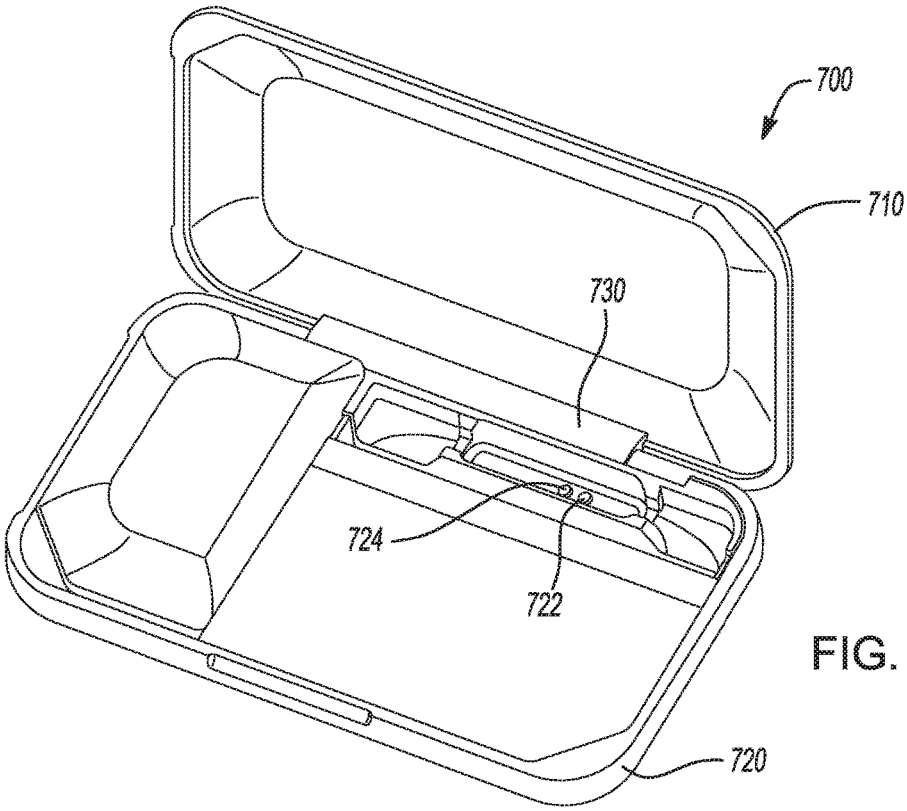
FIG. 7 is a perspective view of an embodiment of a charging case adapted to charge the wireless earphone assembly illustrated in FIG. 1.
Figure 8A:
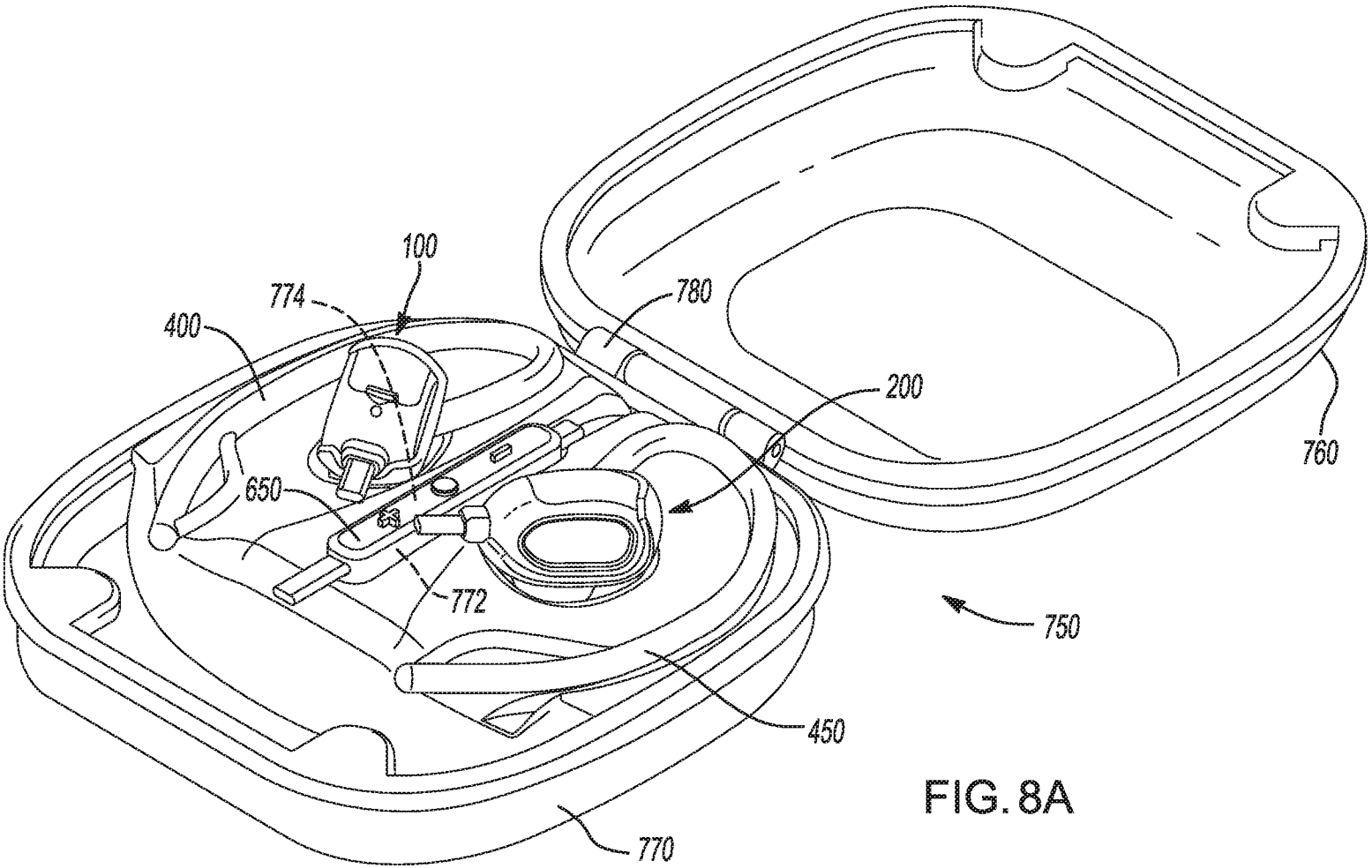
FIGS. 8A and 8B are perspective views of another embodiment of a charging case configured to receive and charge the wireless earphone assembly depicted in FIG. 1.
Figure 8B:
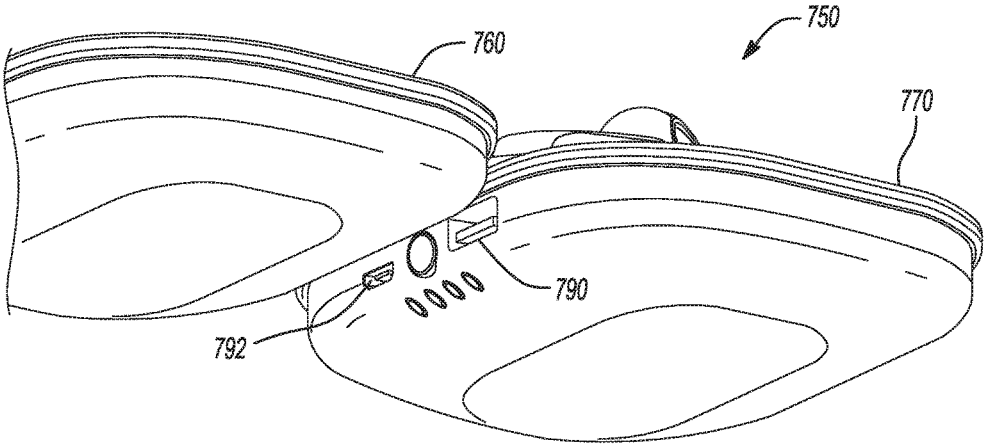

The portable charging cases disclosed herein (see FIGS. 7-8B) are configured to facilitate the charging of the batteries within the earphones and/or controllers while the system is or is not in use or when it is stored in the portable charging case. The charging contacts 622, 624 or 672, 674 correspond and electrically couple to the charging contacts 722, 724, and 772, 774 respectively, on the charging cases 700 and 750. Notably the charging contacts on the adapted charging case and the controller housing are configured to mitigate against misalignment when the controller is inserted into the case, as such misalignment might inhibit charging. Specifically, in the illustrated implementations, the charging case includes a controller compartment that offsets the charging contacts toward one end of the compartment to correspond with corresponding offset contacts on the controller and thereby lessen the likelihood of improper insertion of the controller within the charger case.

In operation, the charging cases (e.g., 700, 750) can extend the operability and battery life of the earphones and the controller when a wall charger is not nearby. This is particularly useful for example when a user is on an extended airline trip or when traveling extended distances or foreign countries without access to suitable power or appropriate electrical power convertors or adaptors.

The charging cases may include a charging detect circuit that detects when no current is being drawn from the controller housing 600 (i.e., when the earphone system is charged) and then automatically turns off the charging process. For example, in one implementation, the charging detect circuit can be provided in the charge case such that once the current or power draw from the charging contacts 622, 624 or 672, 674 is lower than a pre-determined limit the charging circuit can be turned off (see also FIG. 17).

The charging case may also be configured such that the rechargeable battery and charging circuitry contained therein is not only configured to charge the earphone system through the controller contacts, but also includes an external charge port that allows the case to function as a rechargeable battery bank that can power or recharge external devices (e.g., smart phones, tablets and other computing devices) apart from the earphones using for example a power out USB port 790 (see FIG. 8B) that is connected to the case's rechargeable battery (see also FIG. 17). Moreover, the charging case may include circuitry to allow for charging both the earphones and another external device (e.g., smart phone) simultaneously, while at the same time being charged by an external power source that is connected another power-in charging port (see also FIG. 17). The charging case may also be configured to receive power through, for example, a power in USB port 792.

To further secure the controller in aligned position within the charging case (e.g., 700, 750) magnets may be employed to provide additional magnetic alignment between the controller housing and the charging case to better secure the charging contacts there-between. This may be helpful to the user in that it may provide another user detectable indication to ensure the proper alignment of the controller when placed within the conforming compartment for housing the controller housing defined in the case as well as an added safeguard from being inadvertently dislodge (e.g., when traveling etc.) that may assist in maintaining the proper alignment and contact of the corresponding controller and case charging contacts relative to one another.

For example, in one implementation, small magnets (having opposing polarity) can be provided on each end of the controller housing and the charging case. The charging case may include a controller compartment that is formed of a molded polymer or plastic that generally comports with the external shape of the controller. The opposite polarity magnets placed on each end of the controller housing and each end of the controller compartment thereby are capable of providing positive indication to the user of the proper alignment while at the same time further securing in place the alignment of the charging contacts in the charging case and controller.

While magnets may be employed, it should be understood that alternative or supplemental approaches for securing the controller housing in proper alignment to the charging case may be employed. For example, the shape of the controller and corresponding compartment in the case may be such that the controller can be snap-fit into place, strapped down into the case, and/or slid into place and retained therein by a groove or protrusion.

FIG. 9 is a perspective view of an earphone pieces such as the earphone 100 depicted in FIG. 2A. Notably, the earphone piece is attached to a USB to Aux cable 800 for line-in listening that can be used when the wireless (e.g., Bluetooth) connection is disrupted such as when power in the wireless earphone system is depleted, or when the battery level is lower than a critical point that enough power to the earphones is not supplied, or during a battery charging process. The line-in connection or cable adapter 800, includes a micro USB connector 820 that is connected to the speaker housing and a 3.5 mm AUX connector at the opposite end 810 that adapted to being connected to an audio source (not shown). By providing an independent connection (audio and power) to the earphone system, the system may continue to be operational even when the charge in the system operating batteries is depleted and the user can thus avoid down-time when the earphone system is being charged. While FIG. 9 depicts the USB to Aux cable 800 being connected directly to a USB port in the speaker it should be understood that the USB to Aux cable 800 may be connected directly to the controller to effectuate.

Figure 10:
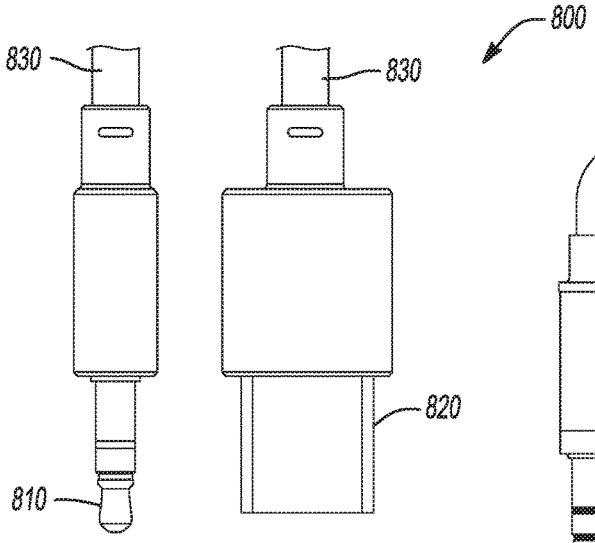
FIG. 10 illustrates two ends of a 3.5 mm AUX to micro USB cable that can be used to route audio from an audio source to the earphone so that the user can utilize the earphones while they are being re-charged or when the battery level is lower than a critical point or when the battery is completely depleted.

FIG. 10 illustrates two ends 810, 820 of a 3.5 mm AUX to micro USB cable 800 that can be used to connect an audio source to the earphone so that the user can utilize audio source to both power and transmit audio to the earphones even while the earphones are being re-charged. An adaptor component 840 that attached to the earphone housing can be employed to provide a seamless integration of the cable 800 into the earphone as depicted in FIG. 9.

Referring to FIGS. 5A-5B and 9-12, when the earphone is operating with a line-in connection to play audio from 3.5 mm AUX over micro USB, the cable 800 with a 3.5 mm AUX contact at one end 810 and a micro USB on the other end 820 connects the earphone to the external audio source. The micro USB end 820 may be plugged into only to a micro USB port 122 on the right earphone 100 to bypass the Bluetooth module on the controller housing 600 and allow the audio signals to go directly from the 3.5 mm AUX to the speaker housing 120 in the earphone 100 through the micro USB port 122.

Alternatively, when the micro USB end 820 is plugged into the micro USB port 632 on the controller 600 (e.g., USB port 632 in FIG. 5A-5B), the Bluetooth module in the controller is bypassed and audio signals are communicated directly from the 3.5 mm AUX to the speaker housing 120 in the earphone 100 through the micro USB port 122. The user can therefore be provided the flexibility to play an audio source without Bluetooth capability or without pairing with the earphones, or when the earphone system in depleted from internal battery power.

Figure 11:
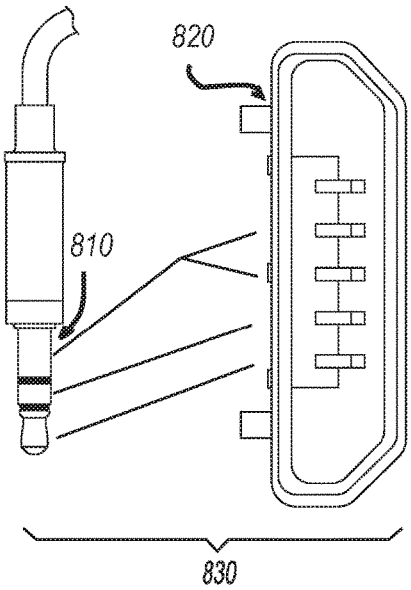
FIG. 11 shows a circuit diagram of correlating the electronic connections or in the 3.5 mm AUX connector to those in the micro USB connector of the cable illustrated in FIG. 10.

FIG. 11 shows a circuit diagram of exemplary electronic connections built into the AUX to micro USB cable 800 of FIG. 10. As shown in the figures, the 3.5 mm AUX connector 810 may include a tip-ring-sleeve (TRS) configuration. In one embodiment as indicated by reference 830, the tip may carry a left audio signal to the fifth pin of the micro-USB connector, the ring may carry a right audio signal to the fourth pin of the micro-USB connector, and the sleeve may connect an electrical ground to the second and third pins of the micro-USB connector.

Other types of connectors may also be adapted and connected to work with the earphones of the present invention. The cable of FIG. 11 may also be adjusted or configured so that other pins or sleeves are connected to other signals.

Figure 12:
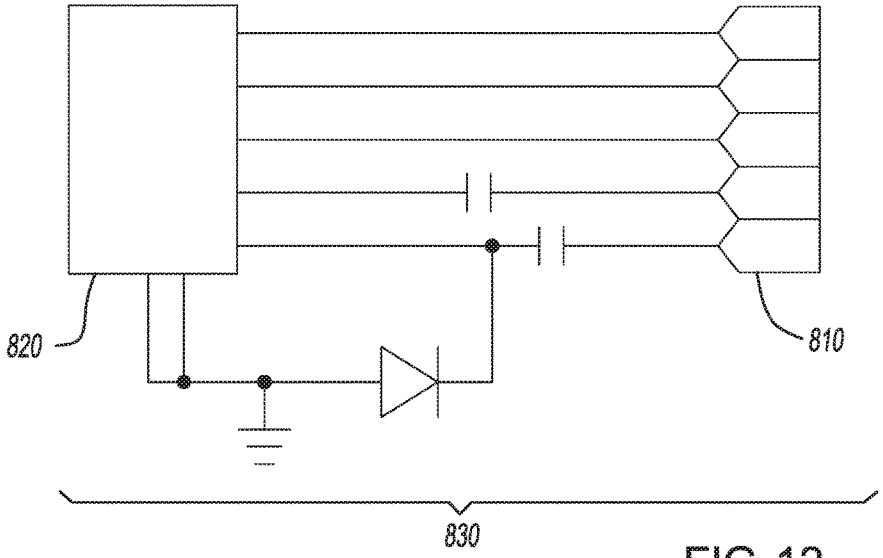
FIG. 12 shows a schematic diagram of exemplary electrical connections between the 3.5 mm AUX connector and the micro USB connector of the cable illustrated in FIGS. 10-11.

FIG. 12 shows a circuit diagram of exemplary electronic circuits built into the AUX to micro USB cable 800 of FIG. 10. As illustrated, a microprocessor or controller is not required in the cable 800 circuitry so that a strictly audio pass through can be effectuated. As shown in the figure, the left (tip), right (ring) and ground (sleeve) contacts of the 3.5 mm AUX connector are directly connected to separate pins (5, 4, 2/3) on the USB connector.

Figure 13:
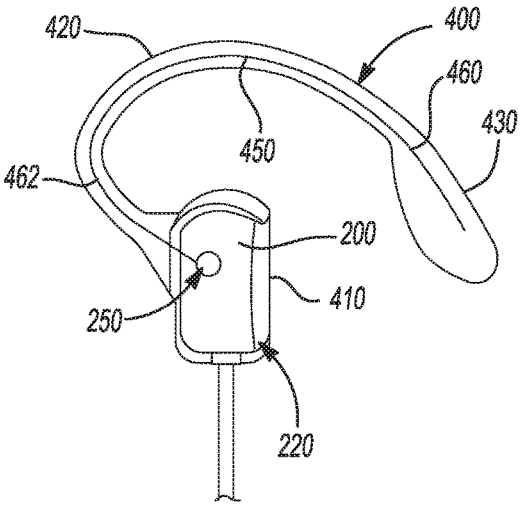
FIG. 13 illustrates a left ear hook and earphone, similar to those illustrated in the prior drawings. The ear hook, however, includes a light tunnel or pipe that may encapsulate or house a light conducting material.

FIG. 13 illustrates a left ear hook 400 and earphone, similar to those illustrated in the prior drawings. The ear hook, however, includes a light tunnel or pipe 460 that is configured to extend from the earphone or earbud and terminate at an opposite end section 430 or region of the ear hook. The light tunnel or pipe 460 may encapsulate or house a light conducting material 462 that can assist in the propagation of the light. The earphone includes one or more light sources like a laser or light emitting diodes (LEDs) 250, which when powered emit light from the earphone into the light tunnel or pipe 460 and the light conducting material 462 to illuminate the ear hook 400. The LED 250 may be powered either internally via the earphone battery or externally via a charger, such as that depicted in FIGS. 7 and 8. The LED may emit a single color or multiple colors of light that can be controlled by the user.

The light pipe 460 may be configured to extend over and cover the LED 250 to minimize light diffusion around the earphone. The light pipe 460 and surrounding region of the ear hook may be formed of sufficiently translucent materials that allow the light to be illuminated therefrom.

The light conducting material 462 may be fiber optic, ABS, clear plastic, glass, or any other material or combination of materials that can conduct or transmit light.

The ear hook 400 and/or light pipe 460 may be uniformly constructed with a consistent translucency throughout. Alternatively the ear hook and/or light pipe may be constructed such that the translucently varies from one region to another. Discrete areas may have greater translucency than other areas such that some areas may be translucent and some areas opaque so that unique or defined light patterns are effectuated from ear hook when the LED is powered and emitting light into the ear hook.

While only a left earphone and ear hook are illustrated in the FIG. 13 it should be understood that an earphone system could include both right and left earphones and ear hooks as previously illustrated, with one or both of the sides having an illuminating ear hook component. Also it should be understood that an earphone system could have multiple interchangeable ear hooks having different illuminating patterns and/or exterior colors and ergonomic configurations. Additionally, it should be understood that ear hook housing and light pipe may be formed as separate components or integrally formed as a single component.

Figure 14:
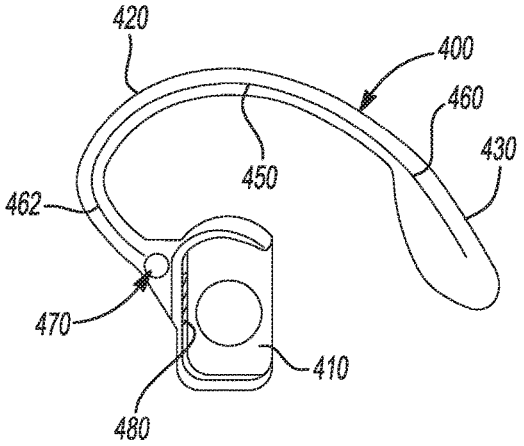
FIG. 14 illustrates another embodiment of an earphone having an illuminating ear hook illustrated in FIG. 13.

FIG. 14 illustrates another embodiment of an earphone having an illuminating ear hook illustrated in FIG. 13. It differs from the ear hook in FIG. 13 in two primary ways. First, the illuminating LED(s) are positioned within the housing of the ear hook as opposed to the housing of the earphone like in the FIG. 13 embodiment. Second, in order to provide power to the LED(s), an electrical contact point 480 is provided between the ear hook component and the housing of the earphone that facilitates transmission of power from the earphone to the LED(s) contained in the ear hook housing.

Hence the contact point 480 is provided to draw power from the earphone to the LED(s) 470 and may be comprised of a set of metallic conductive interfaces on opposing faces of the ear hook and earphone, that are configured to engage or contact one another when the ear hook is attached to the earphone. On the ear hook side, the contact is electrically connected to the LED(s) in the ear hook and, on the earphone side, the contact is electrically connected to the power source that drives the earphone (e.g., an internal battery or external charging source as described elsewhere herein).

Figure 15:
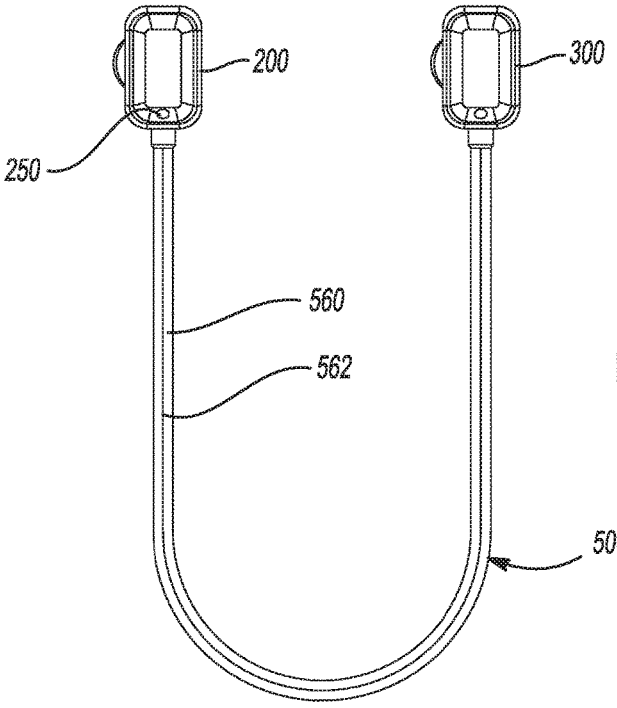
FIG. 15 illustrates a earphone system having a translucent illuminated cable, such as that illustrated in the prior drawings.

FIG. 15 illustrates an earphone system having a translucent illuminated cable, such as that illustrated in the prior drawings. The cable 500, 510 includes a light tunnel or pipe 560 that extends from the right to the left earphone. The light tunnel or pipe 560 may include a light conducting material to facilitate the transmission of light from LED(s) 250 positioned on the left and/or right earphones. When the LED(s) are powered, light is transmitted into the light tunnel or pipe 560 and to the extent included into the light conducting material 562 to thereby illuminate the cable. As was the case in connection with the illuminating ear hooks of FIGS. 13 and 14, multiple LEDs may be used that emit different or the same colors.

The cable housing and light pipe may be separate components or integrally formed as a single component. In addition, the cable and/or light pipe may be uniformly constructed to provide a consistent translucency throughout. Alternatively, the cable housing and/or light pipe may be constructed such that the translucently varies from one region to another. Discrete areas of the cable housing and/or light pipe may have greater translucency than other areas such that some areas may be translucent and some areas relatively more opaque so that unique or defined light patterns are effectuated along the cable when the cable is lit by the LED(s).

In another embodiment, one or more LED(s) are located in the controller. When the LED(s) are powered, light can be transmitted into the light tunnel or pipe of cable and to the extent included into the light conducting material to thereby illuminate the cable. It is understood that other illuminating sources can be used to replace or work with the LED(s) to provide light.

Figure 16:
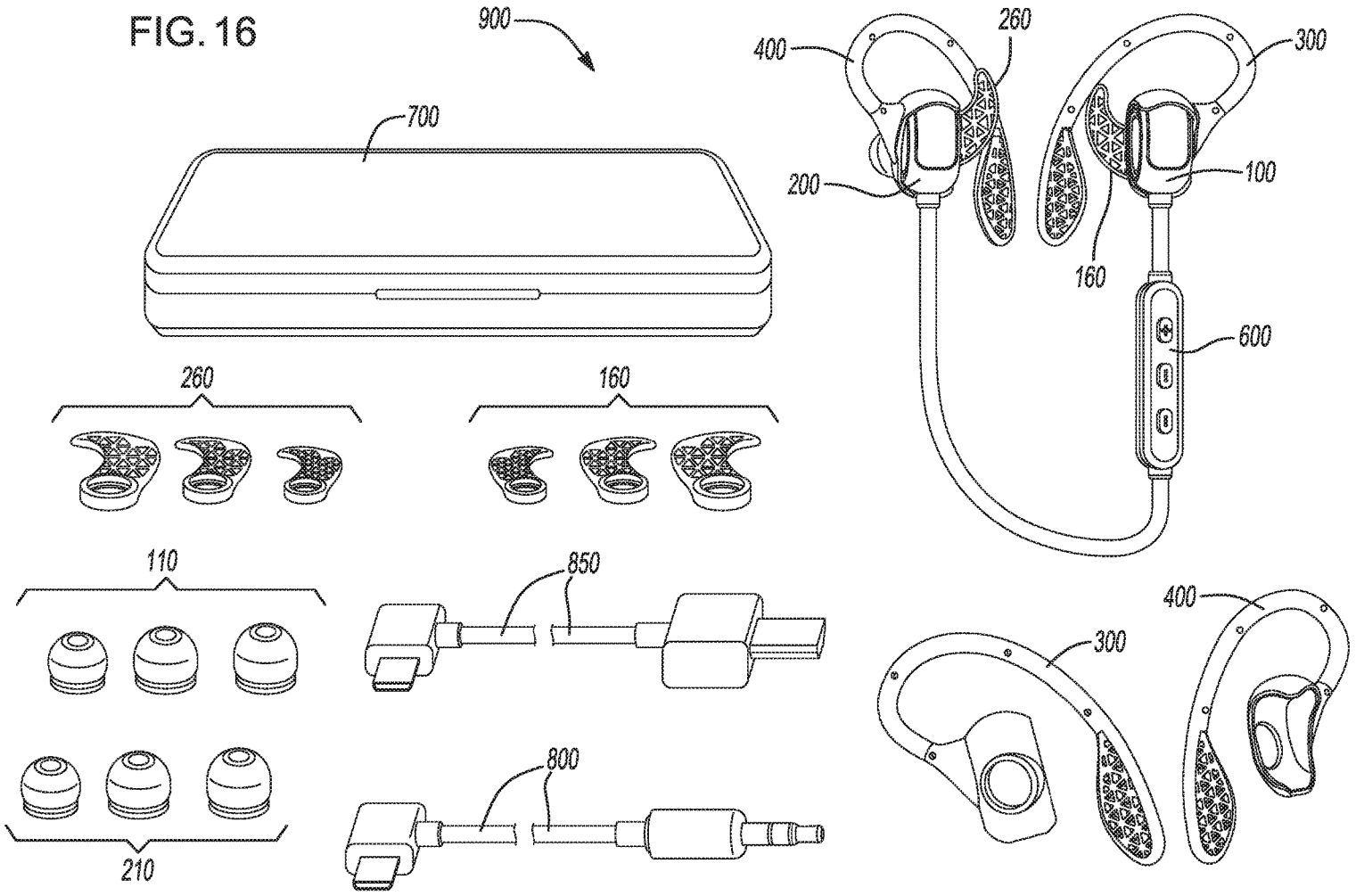
FIG. 16 depicts an earphone system kit in accordance with the teachings herein.

FIG. 16 depicts an earphone system kit 900 in accordance with the teachings herein. The kit 900 includes ear hooks 300, 400, earphones 100, 200, a controller 600, a charging case 700, and cables 800, 850 and replacement or substitute components such as inner ear hooks 160, 260 and ear canal plugs 110, 210 that may be differently sized or configured to provide a modular flexibility to the user so that comfort and fit may be enhanced. Cable 850 is a USB to micro USB cable which can be used to supply power from, for example, a USB output port of a computer or charging circuit, to the micro USB ports 122, 632 on the earphones or controller, or the micro USB port 792 on the charging case 750.

Although various inventive aspects have been disclosed in the context of certain preferred implementations and examples, it will be understood by those skilled in the art that the present invention extends beyond the specifically disclosed embodiments to other alternative embodiments and/or uses of the invention and obvious modifications and equivalents thereof. In addition, while a number of variations of the invention have been shown and described in detail, other modifications, which are within the scope of this invention, will be readily apparent to those of skill in the art based upon this disclosure. It is also contemplated that various combinations or sub-combinations of the specific features and aspects of the embodiments may be made and still fall within the scope of the invention. Accordingly, it should be understood that various features and aspects of the disclosed embodiments can be combined with or substituted for one another in order to form varying modes of the disclosed invention. Thus, it is intended that the scope of the present invention herein disclosed should not be limited by the particular disclosed embodiments described above, but should be determined only by a fair reading of the claims.

Similarly, this method of disclosure, is not to be interpreted as reflecting an intention that any claim require more features than are expressly recited in that claim. Rather, as the following claims reflect, inventive aspects lie in a combination of fewer than all features of any single foregoing disclosed embodiment. Thus, the claims are hereby expressly incorporated into this Detailed Description, with each claim standing on its own as a separate implementation or embodiment.

What is claimed is:

1. A wireless earphone and charging case assembly comprising:

a right earphone having a right speaker housing;

a left earphone having a left speaker housing;

a controller housing comprising a pair of earphone charging contacts;

one or more rechargeable batteries housed in the right speaker housing, left speaker housing or controller housing;

a first cable configured to connect the controller to the right speaker housing;

a second cable configured to connect the controller to the left speaker housing; and a charging case having a pair of case charging contacts located inside of a controller housing compartment and configured to house the right earphone, the left earphone, the first cable, the second cable, and the controller housing, wherein the charging case includes an alignment mechanism to align the case charging contacts of the charging case to the earphone charging contacts on the controller housing to secure a charging process when the controller housing is positioned within the controller housing compartment.

2. The assembly of claim 1, wherein the alignment mechanism includes a first magnet installed in the controller housing and a second magnet installed in the charging case.

3. The assembly of claim 1, further comprising a right ear hook having a cavity configured to removably attach to the right speaker housing and to at least partially encircle a right ear canal plug that is removably attached to the right speaker housing.

4. The assembly of claim 3, further comprising a left ear hook having a cavity configured to be removably attach to the left speaker housing and to at least partially encircle a left ear canal plug that is removably attached to the left speaker housing.

5. The assembly of claim 1, further comprising a cable adapter with a 3.5 mm AUX connector on one end and a micro USB connector on the other end, wherein the micro USB connector is configured to plug into a micro USB port located on the right speaker housing to provide a direct line-in connection.

6. The assembly of claim 5, wherein the cable adapter does not include a microprocessor or a control circuitry and the left, right and ground contacts of the 3.5 mm AUX connector are directly connected to separate pins on the USB connector.

7. The assembly of claim 5, wherein the right and left earphones are configured to play audio from an audio signal received through the cable adapter when the micro USB connector is plugged into the micro USB port on the right speaker housing.

8. The assembly of claim 5, wherein the right and left earphones are configured to play audio from an audio signal received through the cable adapter when the one or more rechargeable batteries are depleted.

9. The assembly of claim 1, wherein the charging case further comprises a charging port that is configured to allow power out of the charging case to facilitate charging an external electronic device.

10. The assembly of claim 9, wherein the charging port is a USB output port.

11. The assembly of claim 1, further comprising a first sleeve configured to receive the first cable and a second sleeve configured to receive the second cable, wherein the first sleeve is located at an end region of the right earphone and the second sleeve is located at an end region of the left earphone.

12. The assembly of claim 11, wherein the first sleeve and the second sleeve are made of thermoplastic polyurethane.

13. The assembly of claim 1, wherein the right earphone has a light source that transmits light to an ear hook attached to the right earphone through a light conducting material housed in a light pipe in the ear hook.

14. The assembly of claim 13, wherein the light source is an LED or a laser.

15. The assembly of claim 1, wherein the assembly includes at least one ear hook that includes an ear hook housing and a wire core element positioned therein.

16. The assembly of claim 15, wherein the wire core element extends longitudinally within the ear hook and is positioned nearer to one side of the ear hook housing than the other side.

17. The assembly of claim 16, wherein the ear hook is configured to include a proximate edge that is configured to reside near the base of the user's outer ear and a distal edge that is configured to reside further away from the base of the user's outer ear, and wherein the wire core element is housed nearer the distal edge as compared to the proximate edge in one or more regions of the ear hook housing.

18. The assembly of claim 5, wherein the direct line-in connection is provided when said one or more rechargeable batteries is depleted.

19. The assembly of claim 5, wherein the direct line-in connection is provided when said one or more rechargeable batteries have a battery level that is lower than a predetermined critical point.

20. The assembly of claim 5, wherein the direct line-in connection is provided when said one or more rechargeable batteries are under a charging process.

* * * * *